United States Patent [19]

Dalbec

[11] 4,028,856

[45] June 14, 1977

[54] COVER WALL CONSTRUCTION

[75] Inventor: Peter M. Dalbec, Clawson, Mich.

[73] Assignee: Mallyclad Corporation, Madison Heights, Mich.

[22] Filed: Jan. 26, 1976

[21] Appl. No.: 652,567

[52] U.S. Cl. ..... 52/281; 52/288; 52/242; 52/466; 52/468; 52/717

[51] Int. Cl.[2] ..... E04B 2/76

[58] Field of Search ..... 52/468, 469, 466, 35, 52/282, 717, 718, 716, 288, 242, 281

[56] References Cited

UNITED STATES PATENTS

| | | | |
|---|---|---|---|
| 1,724,601 | 8/1929 | Kellogg | 52/718 |
| 2,855,871 | 10/1958 | Hantington | 52/469 |
| 3,010,846 | 11/1961 | Bach | 428/461 |
| 3,295,283 | 1/1967 | Griffith | 52/616 |
| 3,342,000 | 9/1967 | Cripe | 52/468 |
| 3,485,405 | 12/1969 | Dement | 52/282 |
| 3,504,473 | 4/1970 | Shanok | 52/717 |
| 3,534,516 | 10/1970 | Cooper | 52/242 |
| 3,606,433 | 9/1971 | Kunevicius | 52/718 |
| 3,742,668 | 7/1973 | Oliver | 52/468 |

*Primary Examiner*—Price C. Faw, Jr.
*Assistant Examiner*—Henry Raduazo
*Attorney, Agent, or Firm*—Dale Austin Winnie

[57] ABSTRACT

Cover wall construction particularly suited for shipboard modernization and including a supporting wall structure installed in front of a wall to be covered, vinyl clad flat surfaced aluminum wall panels, and wall panel retaining members formed for like use at baseboard levels, ceiling height and between next adjacent wall panels to retain the wall panels in fastenerless engagement with the supporting structure provided therebehind.

1 Claim, 7 Drawing Figures

COVER WALL CONSTRUCTION

BACKGROUND OF THE INVENTION

There usually is very little that can be done to modernize or refurbish the living quarters and working spaces aboard large boats and ships, other than to change the color of paint that is used, without it being a major undertaking involving a shipyard overhaul and a considerable amount of time and expense.

Most walls are permanent and intended to serve as watertight bulkheads. Weight changes aboard boats and ships are always important considerations. Fireproof and fire resistant materials have to be used. Certain power supply lines and life supporting systems that are normally exposed can not be permanently obscured behind or within any new walls. And there are numerous other considerations that are due as well.

What appears to be most needed is some type of cover wall, which will obscure the purely functional bulkhead wall and in some way be more modern and decorative in itself. The problem is, however, that it is not always possible to apply a new covering directly over an existing wall or bulkhead on a ship, nor is it usually practical to take the additional space necessary to construct a separate new and more attractive wall immediately in front of an older one.

Most commonly known materials that might be used for purposes such as this are not adaptable for shipboard use. Generally, they are for house and office modernization and include 4 × 8 wall panels, of wood or plaster board composition, which are for use with 2 × 4 studding of wood, or simulated members of like dimension, and are intended to provide wall thicknesses and spaces to accomodate standard insulation, electrical wiring, boxes, etc. as normally required.

Although some efforts have been made to try to use a modified form of moveable wall construction, such as is used in new office buildings, this has not proved successful. The wall panels can not be merely held in position, due to the violent movement a ship can be subjected to, nor can they be permanently fixed in place without rerouting power and life support systems, as previously discussed. The wall panels have to be relatively fixed against movement and still not be permanently secured in place in any manner which would preclude reasonably expedient access therebehind, when and as needed, and, hopefully, without completely destroying the cover wall, due to the expense and inconvenience of rebuilding or replacing it.

SUMMARY OF THE PRESENT INVENTION

This invention relates to a means and method for providing a cover wall over and in front of an older wall or functional bulkhead, aboard ships or elsewhere, for use in modernizng and refinishing living quarters, working spaces, etc.

A wall supporting structure is provided in front of the bulkhead or wall to be covered, wall panels are received against this structure, and panel retaining members secured to the supporting structure, and not the wall panels, are cleverly devised and uniquely used to hold and retain the panel members immovably in place.

The wall supporting structure includes channel members, which are relatively shallow in depth, as compared to their width, disposed on edge at baseboard levels and ceiling heights and which are open rearwardly as disposed vertically therebetween. This enables the supporting wall structure to be erected closely next adjacent the wall being covered, and to provide as much or as little clearance space as circumstances may dictate.

The wall panels are of flat aluminum sheet stock which has one side clad with vinyl, to simulate wood grain paneling or otherwise provide some decoarative texture and color, and they are made sufficiently narrow in width to be relatively light in weight, and easy to cut, fit and handle as may be required. The narrower width, lighter weight, and flatness also facilitates easier storage of replacement panels aboard ship and easier cartage through narrow passageways and restrictive hatches to places where they can be used.

The retaining members are made of a like aluminum stock material, as compared to the wall panels, rather than being extruded, with a rolled form and side edges that are folded under to give them servicable rigidity. They are cut to panel lengths and as fastened to the supporting wall structure between next adjacent wall panels, they serve to locate and hold both wall panels thereto. They also serve a like purpose at baseboard levels and ceiling heights, and in a modified form at inside and outside corners, and thereby relatively fixedly locate and hold all panel edges inmovably to the supporting wall structure.

The advantages of the system proposed include the ability to gain access behind any given wall panel, without destroying it, by stripping away the retainer members along at least two side edges, and in an emergency to require damage or destruction of only one wall panel, which can subsequently be readily replaced.

These and other objects and advantages in the practice of this invention will be more obvious in the detailed description of a preferred form and working embodiment thereof which follows.

DESCRIPTION OF THE DRAWING FIGURES

Figure 1:
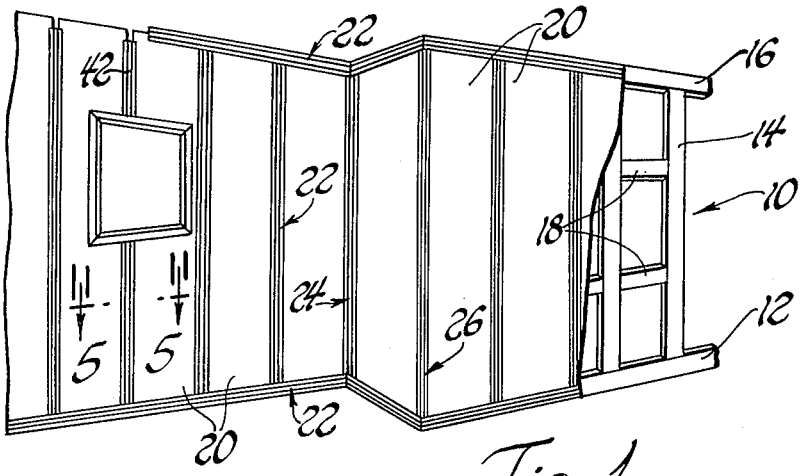
FIG. 1 is a perspective view of the wall construction of the present invention in the process of being erected for use.
Figure 2:
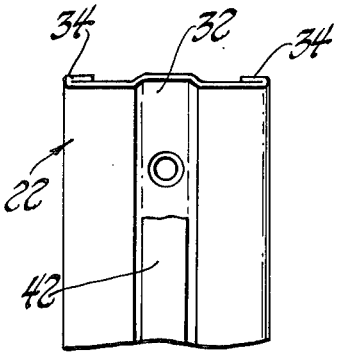
FIG. 2 is an enlarged front perspective view of one end of a panel retaining member in the form used between next adjacent panel members and at baseboard and ceiling heights.

DESCRIPTION OF THE ILLUSTRATED EMBODIMENT:

The new cover wall which is provided by the present invention includes a wall supporting structure 10, commonly known as cribbing, which is essentially a framework of shallow channel sectioned members about 2 inches wide, with legs which provide a depth of about 5/8, inch and made of 0.105 (13 ga.) steel, hot rolled, formed and prime painted.

A first channel member 12 is welded to the deck, wherever the new wall is to be erected, making sure the line is straight and all inside and outside corners are square. The vertical channel members 14 are cut to length, from an eight foot standard length, dependent upon any present or future use of a drop ceiling, and are welded to the baseboard channels 12 on 16 5/8 inch centers.

A ceiling height channel member 16 is next welded on edge to the tops of all the vertical channel members 14 and intermediate pieces 18 are provided at 32 inch centers for added wall panel support, as later described.

Although not specifically shown, two of the vertical channel members can be and are used to provide the inside and outside corners, where required, and suitable standoffs are used where and as desired to space and plumb the wall supporting structure relative to the wall or bulkhead being covered.

Referring now to the actual cover wall, the main parts include wall panels 20, panel retaining members 22 used at baseboard level, ceiling height and between next adjacent panels, and like members 24 which are formed to provide inside and outside corner members as well as serving a panel retaining function.

The wall panels 20 are made from aluminum sheet stock which is clad with a vinyl covering 28 that simulates a wood grain finish or otherwise provides decorative texture and color. Each panel is formed flat and made to a 16 inch width and 96 inch length which makes them individually light in weight, easy to carry around, convenient to store, and to cut and fit to size where and as necessary.

Figure 5:
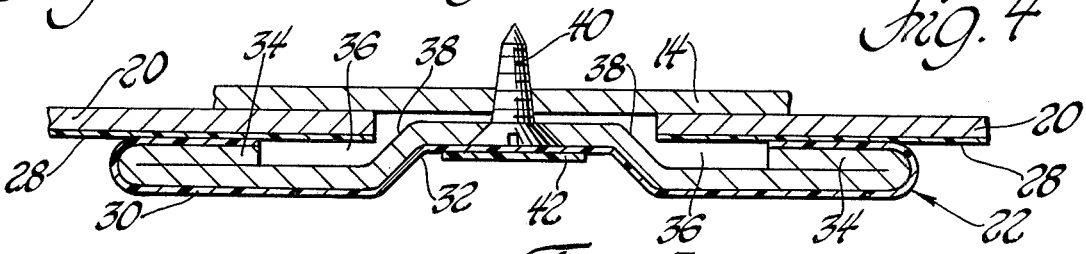
FIG. 5 is a greatly enlarged cross-sectional view through a panel juncture and retaining member as seen in the plane of line 5—5 in FIG. 1 looking in the direction of the arrows.
Figure 6:
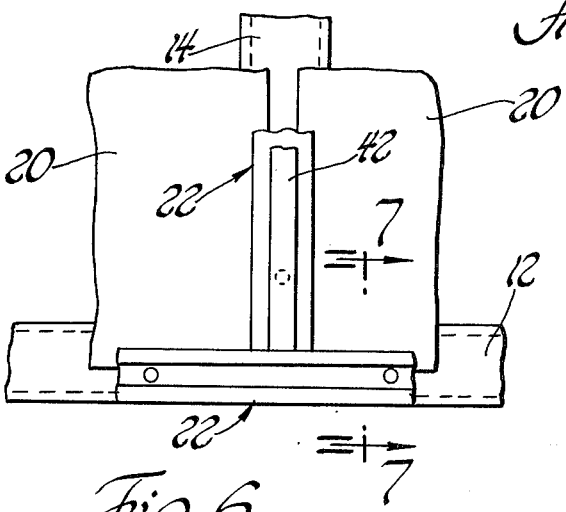
FIG. 6 is a plan view of a baseboard area of the wall construction, showing the dual use of retainer members and relationship of the panel members which are retained thereby.
Figure 7:
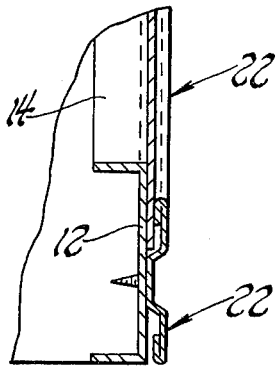
FIG. 7 is an enlarged cross-sectional view, as seen in the plane of line 7—7 in FIG. 6, and looking in the direction of the arrows, showing further details of construction.

The panel retaining members 22 are made from a like aluminum sheet stock comparable to that used for the wall panels 20, are clad with a vinyl covering 30, similar or comparable with that which is used on the wall panels, and are provided in 96 inch lengths. They are formed in cross-section, as best shown in FIG. 5, to include an inwardly offset center portion 32 and with their side edges turned under and laid flat against their back side, as at 34. The center portion 32 will be noted as being inwardly offset, or depressed, sufficiently to dispose the back side thereof at a greater depth than the double thickness of the underturned side edges 34, and less than the thickness of a wall panel to be retained thereby.

The underturned edges 34 of the retaining members include the vinyl cladding provided on the face thereof, so that they will not mark or score the edge of the wall panel received thereunder and in combination with the vinyl clad surface of the wall panels will have better frictional and retaining engagement therewith.

They will also be noted as terminating short of the offset center portion 32, so that a gap 36 is provided between the underturned edges and the stop or locating shoulders 38 provided by the inwardly offset center portion on its back side.

From the foregoing, and particularly having reference to FIG. 5, it will be appreciated that the simple formed retaining members 22, as fastened to the wall supporting structure, will have their center portion drawn tight to the supporting structure members and their outlying underturned edges caused to serve as clamps against the edges of a wall panel received thereunder and that the use of such retaining members at baseboard levels, ceiling heights and between next adjacent panels will serve to securely retain all peripheral edges of each wall panel to the supporting structure and against all relative movement therebetween.

Figure 3:
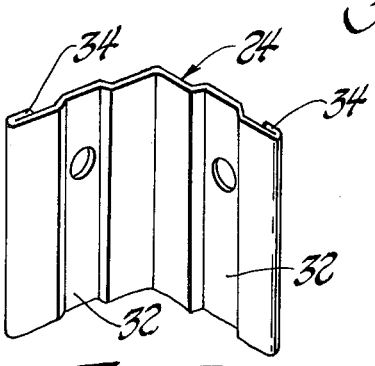
FIG. 3 is a similarly enlarged perspective view of a piece of an inside corner member used between intersecting next adjacent panels.
Figure 4:
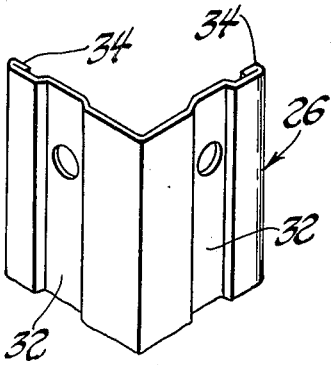
FIG. 4 is an enlarged perspective of an outside corner member for like use.

The corner members 24 and 26, which are shown in FIGS. 3 and 4, will be appreciated as essentially of the same form and like construction as the other retaining members 22, except to provide inside and outside corner covering and retaining members, respectively. Accordingly, like reference numerals are used to designate common similarities.

After the wall supporting structure has been erected, the paneling procedure is essentially as follows:

The retaining members 22 are first installed at baseboard levels to the channel members 12. This is preferably done by drilling through the offset center portion 32 and the baseboard channel member 12, on 12 inch centers and counter sinking to take either rivets or metal screws 40, as shown. A butt joint is used at inside corners and all outside corners are mitre cut.

Retaining members 22 are next measured and cut to desired ceiling heights, taking into account the baseboard retaining member, and inside and outside corner members, as needed, are similarly made ready.

Beginning at an inside corner, the appropriate length corner member 24 is installed, in the same manner as the baseboard retainer members, and preparations are made to put the first wall panel 20 in place.

This includes placing suitable double faced adhesive tape on the back of the wall panel, for engagement with the intermediate cribbing members 18 and, after removing the protective paper on the double faced tape, carefully press the leading edge of the first panel under the clamping edge of the corner member, to a shoulder stop position and then down into the retaining member at the baseboard level.

After the first wall panel is in position, a retainer member 22 is installed to the vertical channel member 14 at its outer or trailing edge, to retain the other peripheral edge, and provide the retaining member for installation of the next panel member.

The paneling thus proceeds in this manner around the room in which it is being provided or from one end to the other of a bulkhead wall being covered, wherever the wall supporting structure has first been erected.

The retaining members at ceiling height will be appreciated as the last to be installed.

It should be noted that all of the panel retaining members are capable of being mitre cut for use as door and window casings and that the wall panels are also capable of being easily cut and formed to fit the depth of recessed door, window or other openings that need to be provided.

Of further note is the use of a cover tape 42, within the recessed center portion of the retaining members 22, 24 and 26, which will obscure the fastener means used and provide a further and final finished appearance.

I claim:

1. Cover wall construction for shipboard modernization and other uses, and comprising;

cribbing for providing a wall supporting structure in front of an older wall to be modernized and including channel members of relatively greater width than depth disposed at baseboard levels, overhead heights and vertically therebetween, panel members for covering and enclosing said cribbing therebehind and including aluminum sheet stock having a vinyl clad exterior surface and a relative size for spanning baseboard to overhead heights and between next adjacent vertically disposed channel members, means for retaining said panel members in engagement with said cribbing including panel retaining members of extended length and minimal width formed to provide, in cross-section, an inwardly offset center portion for fastener engagement to said channel members and reversely bent side edges for overlapping fastenerless engagement with a panel member edge received thereunder, fastener means for engaging said panel retaining members to said channel members at spaced intervals both between next adjacent panel members and at baseboard and overhead heights for both a functional and decorative use, said panel retaining members being formed from like vinyl clad aluminum stock as said panel members and having said vinyl cladding provided over the reversely bent side edges thereof, the center portion of said panel retaining members being set inwardly sufficiently to extend rearwardly less than a panel thickness beyond the reversely bent side edges thereof for both double and single panel edge engagement use, inside and outside corner covering members having each right angle portion of comparable cross-section to said panel retaining members, and pressure-sensitive adhesive coated decorative tape for use with said retaining and corner covering members in obscuring and protecting the headed ends of said fastener means as used within the inwardly set center portions thereof.

* * * * *